US008414668B2

(12) United States Patent
Yokohama et al.

(10) Patent No.: US 8,414,668 B2
(45) Date of Patent: Apr. 9, 2013

(54) STARTING METHOD OF COAL GASIFIER AND STARTING DEVICE THEREFOR

(75) Inventors: Katsuhiko Yokohama, Nagasaki (JP); Hiromi Ishii, Tokyo (JP); Yuichiro Kitagawa, Nagasaki (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 12/452,854

(22) PCT Filed: Jul. 15, 2008

(86) PCT No.: PCT/JP2008/063090

§ 371 (c)(1),
(2), (4) Date: Mar. 15, 2010

(87) PCT Pub. No.: WO2009/096054

PCT Pub. Date: Aug. 6, 2009

(65) Prior Publication Data

US 2010/0180503 A1 Jul. 22, 2010

(30) Foreign Application Priority Data

Jan. 29, 2008 (JP) ..... 2008-043561

(51) Int. Cl.

| | |
|---|---|
| ***B01J 7/00*** | (2006.01) |
| ***C01B 3/36*** | (2006.01) |
| ***C01B 6/24*** | (2006.01) |
| ***C01B 3/02*** | (2006.01) |
| ***C10J 3/08*** | (2006.01) |
| ***C10J 1/207*** | (2006.01) |
| ***C10J 3/00*** | (2006.01) |

(52) U.S. Cl.
USPC ..... 48/197 R; 48/61; 48/62 R; 48/77; 48/210; 423/644; 423/648.1

(58) Field of Classification Search ..... 48/197 R; 423/644
See application file for complete search history.

(56) References Cited

U.S. PATENT DOCUMENTS

| | | | |
|---|---|---|---|
| 4,490,156 | A | 12/1984 | Marion et al. |
| 4,809,624 | A | 3/1989 | Van Der Burgt |
| 5,997,595 | A | 12/1999 | Yokohama et al. |

(Continued)

FOREIGN PATENT DOCUMENTS

| | | |
|---|---|---|
| CA | 1172044 | 8/1984 |
| GB | 2 202 234 A | 9/1988 |

(Continued)

OTHER PUBLICATIONS

European Patent Office, "Supplementary European Search Report" for EP 08791377.8-1270 / 2239312, Oct. 4, 2012.

*Primary Examiner* — Matthew Merkling
(74) *Attorney, Agent, or Firm* — Manabu Kanesaka; Kenneth M. Berner; Benjamin J. Hauptman

(57) ABSTRACT

In a coal gasification furnace adapted to feed pulverized coal thereinto by the use of inert carrier gas and gasify the same, any startup burner can be unnecessitated thereby eliminating any startup combustion chamber. Further, even in the use of a startup burner, it is smaller and lighter in weight than conventional startup burners, allowing the startup combustion chamber to be compact and limiting the height of the entirety of the gasification furnace. As a characteristic feature, a pulverized coal fuel supply passageway (23) to a combustor burner (9) is provided at its midstream portion with a startup gas supply passageway (29) for supply of a startup combustible gas (NG1). After reaching of the temperature of the furnace interior to a first temperature (T1) allowing ignition of pulverized coal with reference to a detected value from furnace interior temperature detecting means (41), transition to combustion by the pulverized coal and carrier gas is effected by increasing the input rate of pulverized coal and carrier gas while decreasing the supply rate of combustible gas (NG1) from the startup gas supply passageway (29).

7 Claims, 7 Drawing Sheets

U.S. PATENT DOCUMENTS

| | | | |
|---|---|---|---|
| 6,033,447 | A | 3/2000 | Moock et al. |
| 2002/0078867 | A1 | 6/2002 | Paisley |

FOREIGN PATENT DOCUMENTS

| | | | |
|---|---|---|---|
| JP | S58-154797 | | 9/1983 |
| JP | S63-135492 | | 6/1988 |
| JP | H11-279568 | A | 10/1999 |
| JP | 2000-119666 | | 4/2000 |
| JP | 2002-161283 | | 6/2002 |
| RU | 2009402 | C1 | 3/1994 |
| RU | 49186 | U1 | 11/2005 |
| WO | WO 02/40618 | A1 | 5/2002 |

Related Art

Related Art

STARTING METHOD OF COAL GASIFIER AND STARTING DEVICE THEREFOR

BACKGROUND OF THE INVENTION

1. Field of the Invention

The present invention relates to a starting method and a device therefor for starting the operation of a coal gasifier in which pulverized coal is charged into the furnace by means of inert transfer-gas (carrier-gas); more in detail, the invention relates to a starting method preferred for starting the operation of the coal gasifier by means of flammable gas, and a device for enforcing the starting method.

2. Background of the Invention

In a coal gasifier of a pressurized two-stage entrained-bed type and an air blowing type the furnace which includes a combustor and a reductor; the ash content in the coal as fuel is melted; vitreous slag is formed in the furnace and discharged therefrom; thus, the inner wall of the furnace in operation is covered with the melted slag. Hence, in a case where a starting burner for starting the operation of the furnace is provided at the combustor side of the furnace, the tip part of the starting burner the part which protrudes toward the furnace inside is covered with the slag when the starting burner is stopped and the operation of the furnace is stopped for a long duration of time before the next operation; thus, the restart of the furnace operation becomes difficult; therefore, the starting burner is needed to be, as it used to be, placed at a starting combustion chamber that is provided independently from the combustor.

FIG. 6 as an example shows a basic configuration as to the starting system for the conventional coal gasifier. As shown in FIG. 6, a coal gasifier 02 comprises a pressure vessel that is provided with a combustor 03 at the inner lower side of the furnace, a reductor burner 04 at the upper side of the combustor 03, and a warm-up burner 06 at the lower side of the combustor burner 03 as well as at the lower side of a slag tap 05.

The coal (pulverized coal) that is transferred by nitrogen gas (carrier gas) through the fuel supply passage 08 as well as air is thrown into a combustor 07 inside the coal gasifier 02 via the combustor burner; thereby, in the furnace, hot combustion gas is generated mainly by the combustion of the coal. Further, the melting slag is formed, being separated from the hot combustion gas; some part of the slag adheres to the inner wall inside the furnace and drops down along the wall; and some part of the slag directly drops down to the bottom of the furnace. Thus, the generated slag is discharged downward through the slag tap 05.

In addition, below the slag tap 05, cooling water 09 for cooling the discharged slag through the slag tap is stored Also via a reductor burner 04 that is placed over the combustor burner 03, the coal (pulverized coal) that is transferred by nitrogen gas (carrier gas) as well as air through the fuel supply passage 010 is thrown into a reductor 011 arranged inside the coal gasifier 02. In the reductor 011, the coal is mixed with the hot gas, and a coal gasification reaction is performed in a reducing atmosphere so as to yield flammable gas.

In starting the operation of the coal gasifier 02, the warm-up burner 06 is used; thereby, auxiliary fuel for warming-up the furnace as well as air or oxygen is supplied to the warm-up burner 06 through which the auxiliary fuel as well as air or oxygen is thrown into a start-up combustion chamber 012 arranged inside the coal gasifier 02. The heat produced by the combustion reaction between the auxiliary fuel and air-or-oxygen warms up the inside of the coal gasifier 02; after the temperature inside the furnace 02 exceeds the ignition temperature of the pulverized coal, the pulverized coal together with air is thrown into the combustor 07 via the combustor burner 03; at the same time, the supply of the auxiliary fuel for warm-up is stopped.

The subject is now changed into the conventional technology. The patent reference 1 (JP2002-161283) discloses a method for starting-up the coal gasifier.

As shown in FIG. 7 of this application, the furnace according to the patent reference 1 comprises:

- a coal gasifier (a furnace body) 020;
- a coal burner 022 and a coal burner 023 that are provided at the coal gasifier 020, thereby pulverized coal and oxygen are supplied to a furnace-inside 021 in the furnace body via the burners 022 and 023, and the pulverized coal is burned so that the furnace-inside 021 is heated up and the coal is gasified;
- a slag tap 024 that is provided at the lower side of the coal burner 023, thereby the melted slag is discharged via the slag tap 024;
- a tap burner 025 that is provided at the lower side of the slag tap 024, thereby the tap burner heats up the slag tap 024.

In the case of starting the operation of the coal gasifier, before pulverized coal is supplied toward the coal burners 022 and 023, the coal through the tap burner 025 is burned so as to heat up the slag tap 025 and raise the temperature of the furnace-inside 021.

However, as shown in FIG. 6, in the warm-up burner (the start-up burner) 06 of the conventional technology, it is needed that a start-up combustion chamber 012 is provided at the lower side of the combustor 07 in the coal gasification (melting) furnace 02, and the warm-up burner 06 is arranged there; thus, the height of the whole coal gasification furnace 02 increases, and the whole system is upsized; further, the number of the stand-pipes that surrounds and configures the pressure vessel 02 also increases; as a result, the manufacturing cost of the furnace increases.

In addition, according to the disclosed technology of the patent reference as is the case with the above conventional technology; the tap burner needs to be placed below the slag tap; thus, the height of the coal gasifier is increased, the pressure vessel is upsized, and the manufacturing cost of the furnace is increased.

SUMMARY OF THE INVENTION

In view of the above-described background, the present invention aims at providing a starting method of a coal gasifier and a starting device thereby, whereby pulverized coal is transferred toward the furnace inside by use of an inert transfer gas and the coal thrown into the furnace inside is burnt so that the coal is gasified, wherein a warm-up (start-up) burner can be dispensed with, and a start-up combustion chamber can be accordingly eliminated; a start-up combustion chamber can be down-sized in comparison with the conventional start-up combustion chambers, even when a start-up chamber has to be provided; and, the height of the whole furnace can be restrained.

The first invention to achieve the above-described objectives is a starting method of a coal gasifier thereby pulverized coal is transferred to the inside of the furnace by use of an inert transfer gas to gasify the coal thrown into the furnace, the method comprises the steps of:

- supplying a flammable gas for starting-up the furnace to a part way of a fuel supply passage for supplying pulverized coal to a combustor burner;

reducing flow rate of the flammable gas after the temperature of the inside of the furnace reaches a first temperature at which the pulverized coal can be ignited; and increasing supply rates of the pulverized coal and the transfer gas in response to the above step of reducing the flow rate of the flammable gas, so that a start-up combustion is shifted to a normal operation combustion performed by the pulverized coal and the transfer gas. In the next place, the second invention is a starting device of a coal gasifier thereby pulverized coal is transferred to the inside of the furnace by use of an inert transfer gas to gasify the coal thrown into the furnace, the device comprises:

a starting gas supply passage for supplying a flammable gas for starting-up the furnace to a part way of a fuel supply passage for supplying pulverized coal to a combustor burner;

a temperature sensing means for sensing the temperature of the inside of the furnace; and a start control means for controlling the operation of the furnace, wherein the flow rate of the flammable gas is reduced after the temperature of the inside of the furnace reaches a first temperature at which the pulverized coal can be ignited, while the supply rates of the pulverized coal and the transfer gas are increased in order to sift the start-up combustion to a normal operation combustion performed by the pulverized coal and the transfer gas.

According to the first invention as to a starting method as well as the second invention as to a starting device, a flammable gas is supplied onto a part way of a fuel supply passage for supplying pulverized coal toward a combustor burner; the flow rate of the flammable gas is reduced, after the temperature of the furnace inside has reached a first temperature at which the pulverized coal can be ignited; then, the supply rates as to the pulverized coal and the transfer gas are increased so that the start-up combustion is shifted to a normal (operation) combustion performed by the pulverized coal and the transfer gas; therefore, the coal gasifier can be started up in a manner that the combustor burner is used also as a warm-up (start-up) burner.

In addition, it becomes unnecessary to provide a warm-up burner besides the combustor burner in the combustor; thus, the warm-up burner can be free from an apprehension that the burner is submerged in the solidified slag derived from the fuel coal; therefore, a stable start-up of the furnace can be achieved. Further, since the installation of the warm-up burner (besides the combustor burner) can be dispensed with, the start-up combustion chamber becomes unnecessary; thus, the coal gasifier can be compact (the height can be reduced); further, the numbers of the stand-pipes configuring the pressure vessel can be reduced; as a result, the manufacturing cost of the furnace can be reduced.

Moreover, the coal gasifier is directly heated up by the combustor burner that acts as a start-up (warm-up) burner during the start-up operation; thus, the temperature of the furnace inside can be effectively raised, namely, the heating-up performance as to the furnace inside can be enhanced; therefore, the fuel for starting-up the furnace can be saved.

A preferable mode of the above-described first invention is the starting method of a coal gasifier, the furnace further being provided with an assist warm-up burner placed below the combustor burner and the slag tap, the method further comprises the steps of:

heating the inside of the furnace by use of the assist warm-up burner till the temperature of the inside of the furnace reaches a second temperature which is lower than the first temperature; and supplying the flammable gas to the fuel supply passage after the above step of heating-up the inside of the furnace by use of the assist warm-up burner.

Further, a preferable mode of the above-described second invention is the starting device of a coal gasifier, the furnace further comprising an assist warm-up burner placed below the combustor burner as well as the slag tap; and, the start control means further comprising a start assist burner controller for controlling the start-up operation of the furnace so that the furnace inside is heated up by use of the assist warm-up burner till the temperature of the furnace inside reach a second temperature lower than the first temperature, while the flammable gas is supplied onto (the part way of) the fuel supply passage so as to continue the heat-up after the temperature of the furnace inside has reached the second temperature.

According to the preferable mode of the first invention as to a starting method as well as the preferable mode of the second invention as to a starting device, the assist warm-up burner and the combustor burner perform the warming-up of the furnace during the start-up operation, during the start-up operation of the furnace; thus, in comparison with the conventional way where only a warm-up burner performs the warming-up of the furnace, the time span in which the temperature of the pulverized coal supplied to the furnace inside reaches the first temperature T1 at which the pulverized coal ignites can be reduced. Further, in comparison with the warm-up burner that is used in the conventional furnaces, the assist warm-up burner can be of a small size; thus, the height of the coal gasifier can be reduced. In addition, the upper side and the lower side of the slag tap furnace can be evenly heated up; the slag discharge during the start-up operation, namely during the incipient pulverized coal charging, can be stabilized. Another preferable mode of the above-described first invention is the starting method of a coal gasifier, wherein an inert sealing gas is supplied between an outlet of a pulverized coal hopper and a junction point as to the fuel supply passage and a starting gas supply passage when supplying the flammable gas for starting-up the furnace to the fuel supply passage so that back-flow of the starting flammable gas in the passage is prevented by use of the inert sealing gas.

Further, another preferable mode of the above-described second invention is the starting device of a coal gasifier, the furnace further comprising an inert sealing gas passage for supplying an inert sealing gas between the outlet of the pulverized coal hopper and the coupling point of the starting flammable gas supply passage on the fuel (pulverized coal) supply passage while the sealing flammable gas is supplied onto the pulverized coal supply passage, so that the flammable gas is prevented from flowing back in the fuel (pulverized coal) supply passage toward the hopper, by use of to the inert sealing gas.

According to the preferable mode of the first invention as to a starting method as well as the preferable mode of the second invention as to a starting device, the starting gas (the flammable gas) is prevented from flowing back in the fuel (pulverized coal) supply passage toward the hopper, during the start-up operation of the furnace. In this way, the flammable gas for the start-up operation can be stably supplied to the furnace during the start-up operation; thus, the start-up of the furnace can be stabilized.

According to the present invention, a starting method of a coal gasifier and a starting device thereby can be provided, whereby pulverized coal is transferred toward the furnace inside by use of an inert transfer gas and the coal thrown into the furnace inside is gasified, wherein a warm-up (start-up) burner can be dispensed with, and a start-up combustion chamber can be accordingly eliminated; a start-up combustion chamber can be down-sized in comparison with the conventional start-up combustion chambers, even when a start-up chamber has to be provided; and, the height of the whole furnace can be restrained.

DETAILED DESCRIPTION OF THE PREFERRED EMBODIMENTS

Hereafter, the present invention will be described in detail with reference to the embodiments shown in the figures. However, the dimensions, materials, shape, the relative placement and so on of a component described in these embodiments shall not be construed as limiting the scope of the invention thereto, unless especially specific mention is made.

(The First Embodiment)

Figure 1:
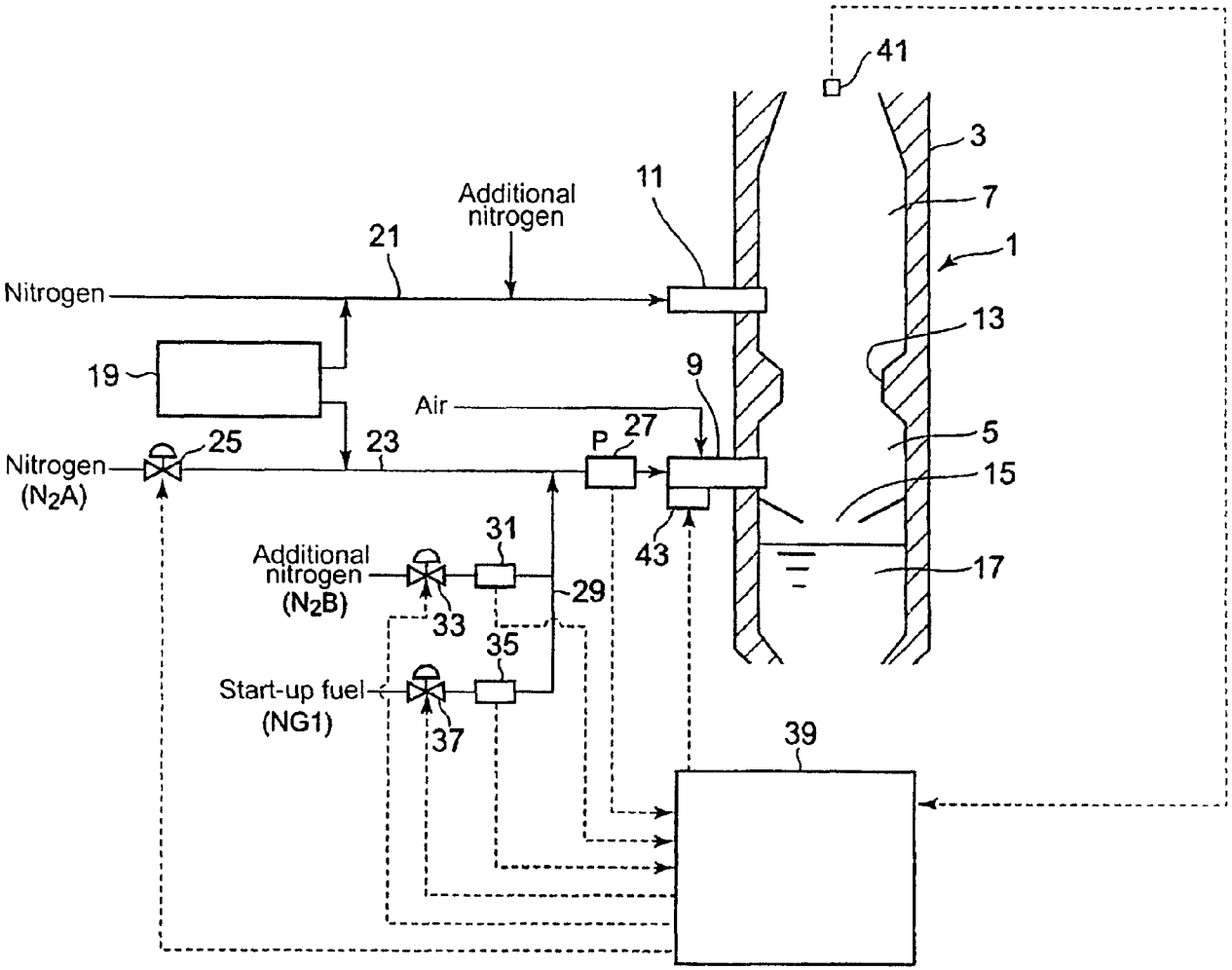
FIG. 1 shows an outline of a coal gasifier according to the first embodiment of the present invention.
Figure 2:
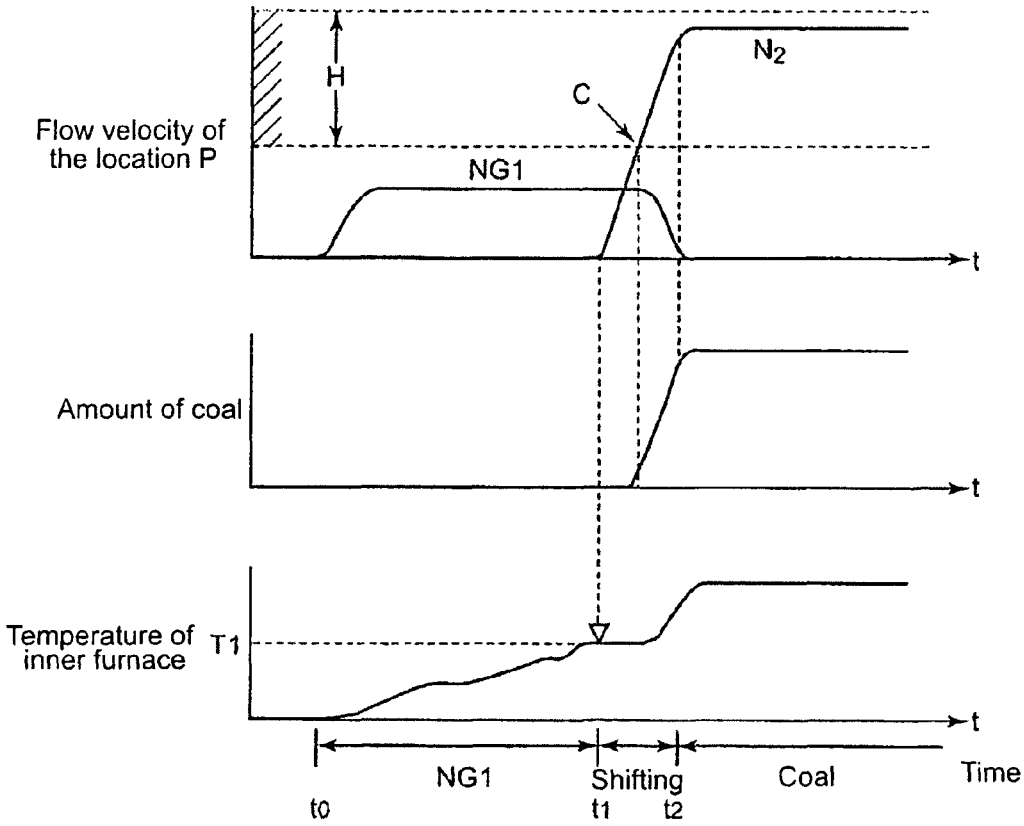
FIG. 2 explains the furnace operation transition during the start-up of the furnace according to the first embodiment.

The first embodiment according to the present invention is now explained in consultation with FIGS. 1 and 2. FIG. 1 shows an outline of a coal gasifier according to the first embodiment of the present invention.

As shown in FIG. 1, a pressure vessel 3 forms a coal gasifier 1 that gasifies coal, and comprises a combustor (a combustion furnace) 5 which generates heat and a reductor (a reduction furnace) 7 which performs coal gasification reaction by use of the heat generated in the combustor 5. The combustor 5 is provided with at least one combustor burner (a combustion burner) 9 and the reductor 7 is provided with at least one reductor burner 11; in the attached figures, only one combustor burner and only one reductor burner are shown (the other burners are omitted from the figures).

Between the combustor burner 9 and the reductor burner 11, a partition area (a neck area) 13 is formed; below the combustor burner 9, a slag discharge port, namely slag tap 15, is provided so that the slag drops downward through the slag tap. At the bottom part of the pressure vessel, cooling water 17 for cooling the dropped slag is stored.

Figure 5:
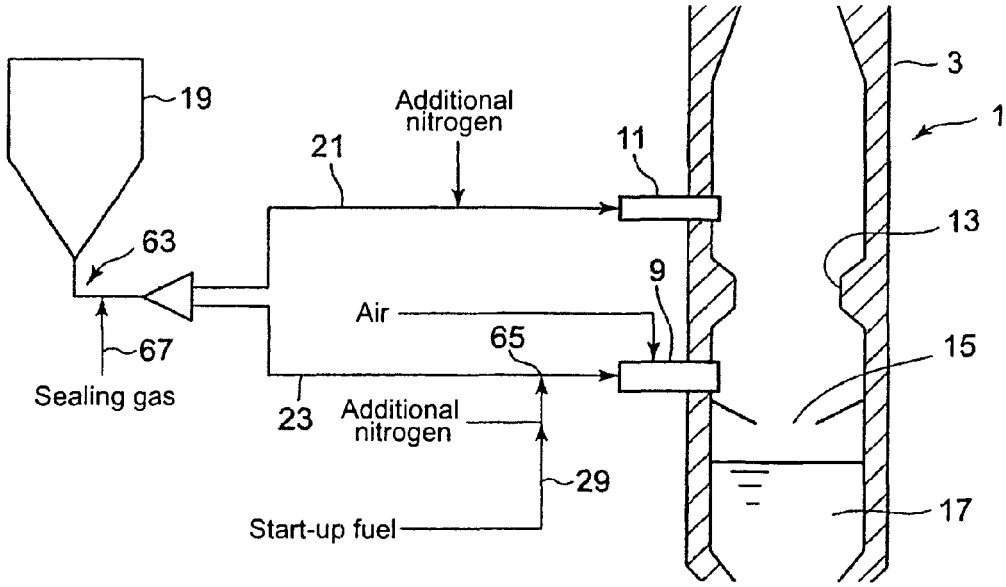
FIG. 5 shows an outline of a coal gasifier according to the third embodiment of the present invention.
Figure 6:
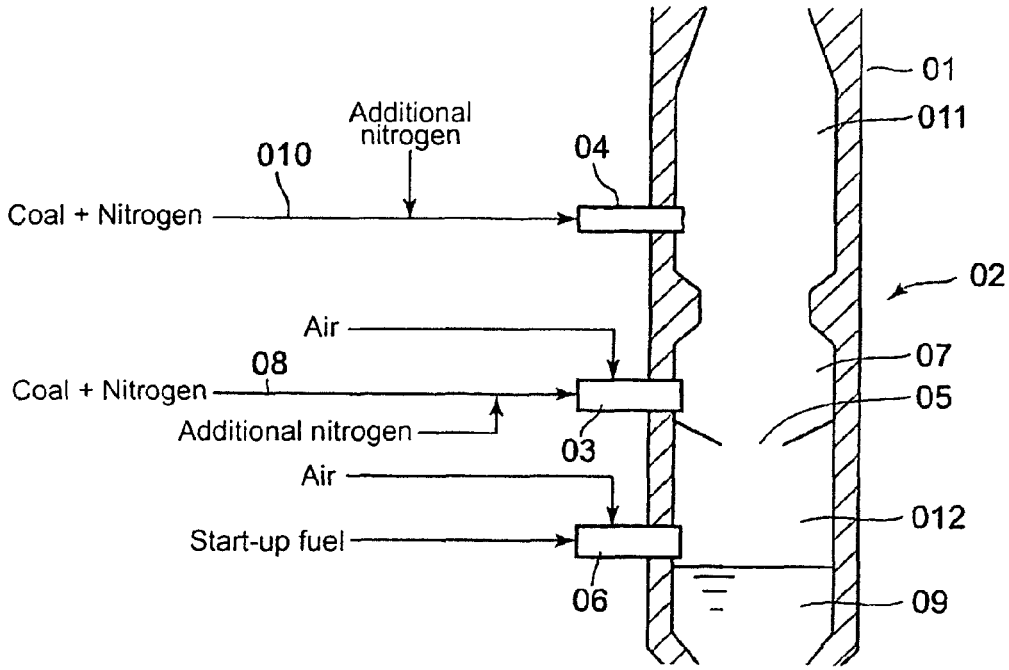
FIG. 6 shows an outline of a coal gasifier according to the conventional technology.
Figure 7:
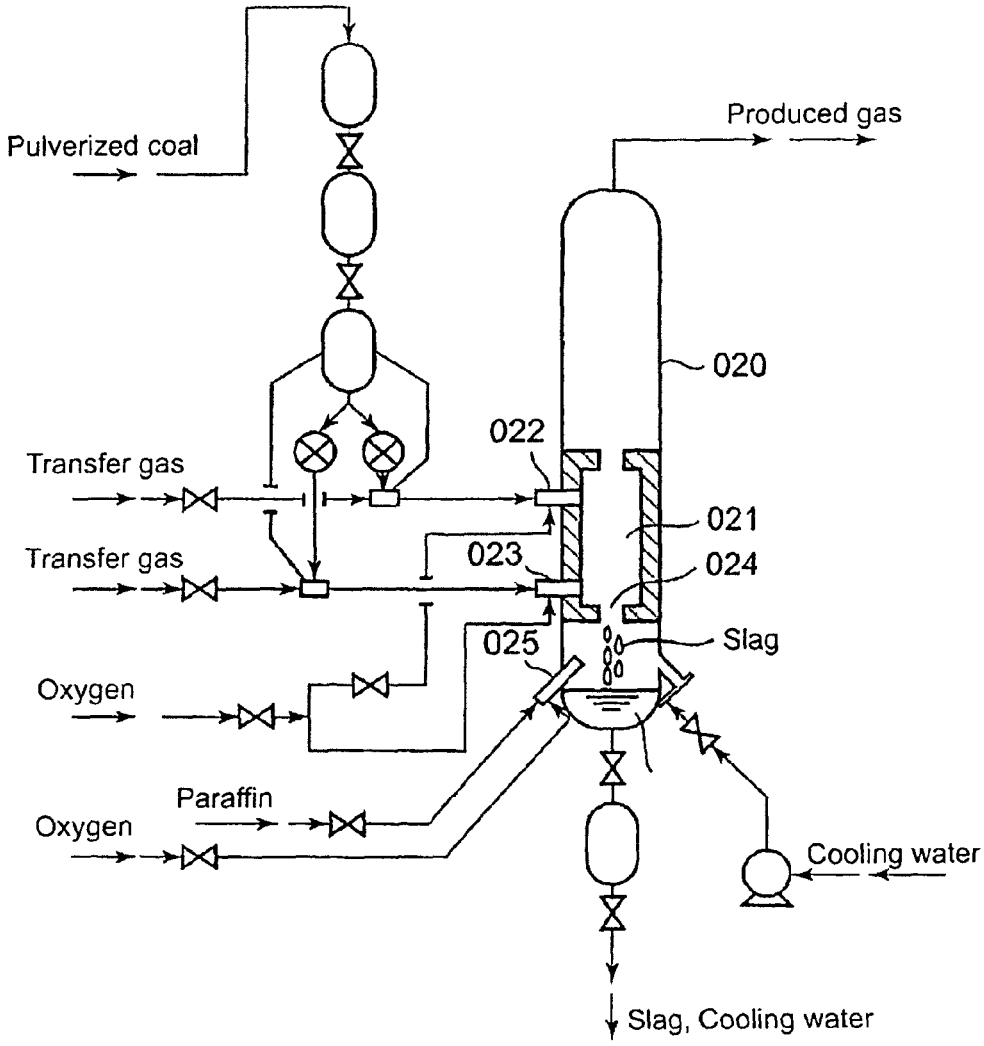
FIG. 7 shows a whole configuration of a coal gasifier according to the conventional technology.

The coal used as fuel that is pulverized into pulverized coal of pertinent particle sizes is transitorily stored in a coal supply hopper (a pulverized coal hopper) 19 (cf. FIG. 5). Inert nitrogen (carrier gas) is supplied to the outlet of the hopper 19 so as to transfer the coal (the pulverized coal), and the pulverized coal is transferred through a (gas coal) transfer pipe 21 to the reductor burner 11, while additional nitrogen is supplied to the transfer pipe 21.

The pulverized coal is transferred to the combustor burner 9 through a (coal) fuel supply passage 23. Further, the supply flow rate of the coal transfer nitrogen gas ($N_2A$) is adjustable by use of a flow regulating valve 25. In addition, a flow meter 27 is provided at a location P at the combustor inlet side of the (coal) fuel supply passage 23. Based on the information as to the flow rate detected by the flow meter 27 and the other data such as the diameter of the (coal) fuel supply passage and the detected temperature of the inside of the supply passage, the flow velocity of the pulverized coal in the passage to be transferred to the combustor burner 9 is calculated.

Further, air or oxygen is supplied to the combustor 9, and the air or oxygen is merged with the pulverized coal transferred through the supply passage 23 by the nitrogen ($N_2A$), so as to be thrown into the combustor where a combustion gas of a high temperature is generated mainly due to the coal combustion. The coal thrown in the reductor 7 is mixed with the high temperature combustion gas generated in the combustor, so that a gasification reaction is performed to generate a flammable gas derived from the coal, under a hot reducing atmosphere.

As shown in FIG. 1, a starting gas (a fuel gas) supply passage 29 is connected onto the (coal) fuel supply passage 23; an additional nitrogen ($N_2B$) is supplied via a flow meter 31 and a flow regulating valve 33, while a flammable gas (NG1) as a start-up fuel such as natural gas or propane (liquefied petroleum) gas is supplied via a flow meter 35 and a flow regulating valve 37.

In the next place, the explanation about the start control means 39 (FIG. 1) is given in consultation with FIG. 2 as to the furnace operation transition during the start-up of the furnace.

To the start control means 39, a detected signal from a furnace inside temperature sensor 41 for detecting the temperature of the furnace inside is inputted together with a signal from the flow meter 27 at the location P on the inlet side of the combustor burner 9, a signal from the flow meter 31 as to the additional nitrogen ($N_2B$), and a signal from a flow meter 35 as to the flammable gas (NG1) as the start-up fuel.

The flow rate adjustments as to the flow rates of the nitrogen ($N_2A$), the additional nitrogen ($N_2B$), and the start-up fuel (the flammable gas) are performed chiefly by the flow regulating valves 25, 33 and 37 respectively.

At first, in starting of the operation of the coal gasifier 1, air is let into the combustor burner 9 to activate an igniter 43 installed at the tip part of the combustor burner. The igniter 43 may use an ignition device of a red heated wire type, plasma generating type and so on. After the igniter is activated, the flow regulating valves 37 is opened so that a starting gas (a flammable gas, e.g. NG1) begins to be delivered with a predetermined flow speed. A natural gas (NG1) as a start-up fuel is supplied to the (coal) fuel supply passage 23 through the starting gas supply passage 29; then, the natural gas is ignited. After the natural gas is ignited, the activation of the igniter 43 is ceased.

When the start-up gas fuel (NG1) is ignited at a time point t0, the inner temperature of the coal gasifier 1 starts rising as shown in FIG. 2. As the pulverized coal can be ignited when the temperature of the furnace 1 reaches a first temperature T1 at a time point t1, the supply of the start-up gas fuel (NG1) is shifted to the supply of the pulverized coal.

When the temperature inside of the furnace reaches the first temperature T1, the openings as to the flow regulating valves 25 and 33 are adjusted so that the flow rates of the carrier gas ($N_2A$) and the additional nitrogen ($N_2B$) are controlled, and the velocity of the flow in the coal fuel supply passage 23 at the location P is made to be within a predetermined stable transfer flow velocity range H as to the pulverized coal by the aid of the nitrogen ($N_2A$, $N_2B$) and the start-up fuel (NG1).

In other words, if the pulverized coal transfer becomes unstable in a case where the velocity of the flow in the coal fuel supply passage 23 fluctuates, then a stable coal-gasification cannot be obtained; thus, the flow velocity is controlled so as to be within a predetermined stable transfer flow velocity range H.

When the flow velocity reaches a lower limit C of the stable transfer flow velocity range H, the pulverized coal supply is started. The openings of the flow regulating valves 25 and 33 are controlled to increase the flow rate of the pulverized coal while the flow regulating valve 37 is controlled to make the flow rate of the start-up fuel (NG1) decreased so that the reduction of the flow rate of the start-up fuel (NG1) is compensated with the increase of the flow rate of the inert nitrogen gas. Finally, the supply of the start-up fuel (NG1) is stopped at a time point t2 so that the start-up operation is shifted to the normal operation only with the pulverized coal.

According to the first embodiment as described above, the start-up gas (NG1) is supplied to a part way of the coal fuel supply passage 23 for supplying pulverized coal toward the combustor burner 9; the flow rate of the start-up gas (NG1) is reduced after the temperature inside of the furnace has reached the temperature T1 at which the pulverized coal can be ignited. Then, the supply rates as to the pulverized coal and the transfer gas are increased so that the start-up combustion is shifted to a normal (operation) combustion performed by the pulverized coal and the transfer gas. In this way, the coal gasifier 1 can be started up by making the combustor burner 9 acts also as a start-up burner (a warm-up burner) for starting the operation of the furnace.

Thus, it becomes unnecessary to provide a start-up burner (a warm-up burner) in the combustor for starting the operation of the furnace besides the combustor. Accordingly, the warm-up burner can b'e free from an apprehension that the burner is submerged in the solidified slag derived from the fuel coal Therefore, a stable start-up of the furnace can be achieved.

Moreover, thanks to the advantage that the start-up burner (the warm-up burner) besides the combustor burner can be dispensed with, the start-up combustion chamber also becomes unnecessary; thus, the height of the gasifier can be reduced; further, the number of the stand-pipes configuring the pressure vessel 3 of the coal gasifier 1 can be reduced; as a result, the manufacturing cost of the furnace can be reduced.

Moreover, the combustor 5 of the coal gasifier 1 is directly heated up by the combustor burner 5 that acts also as a start-up (warm-up) burner during the start-up operation; thus, the temperature of the furnace inside can be effectively raised, namely, the heating-up performance as to the furnace inside can be enhanced; therefore, the fuel for starting-up the furnace can be reduced.

(The Second Embodiment)

Figure 3:
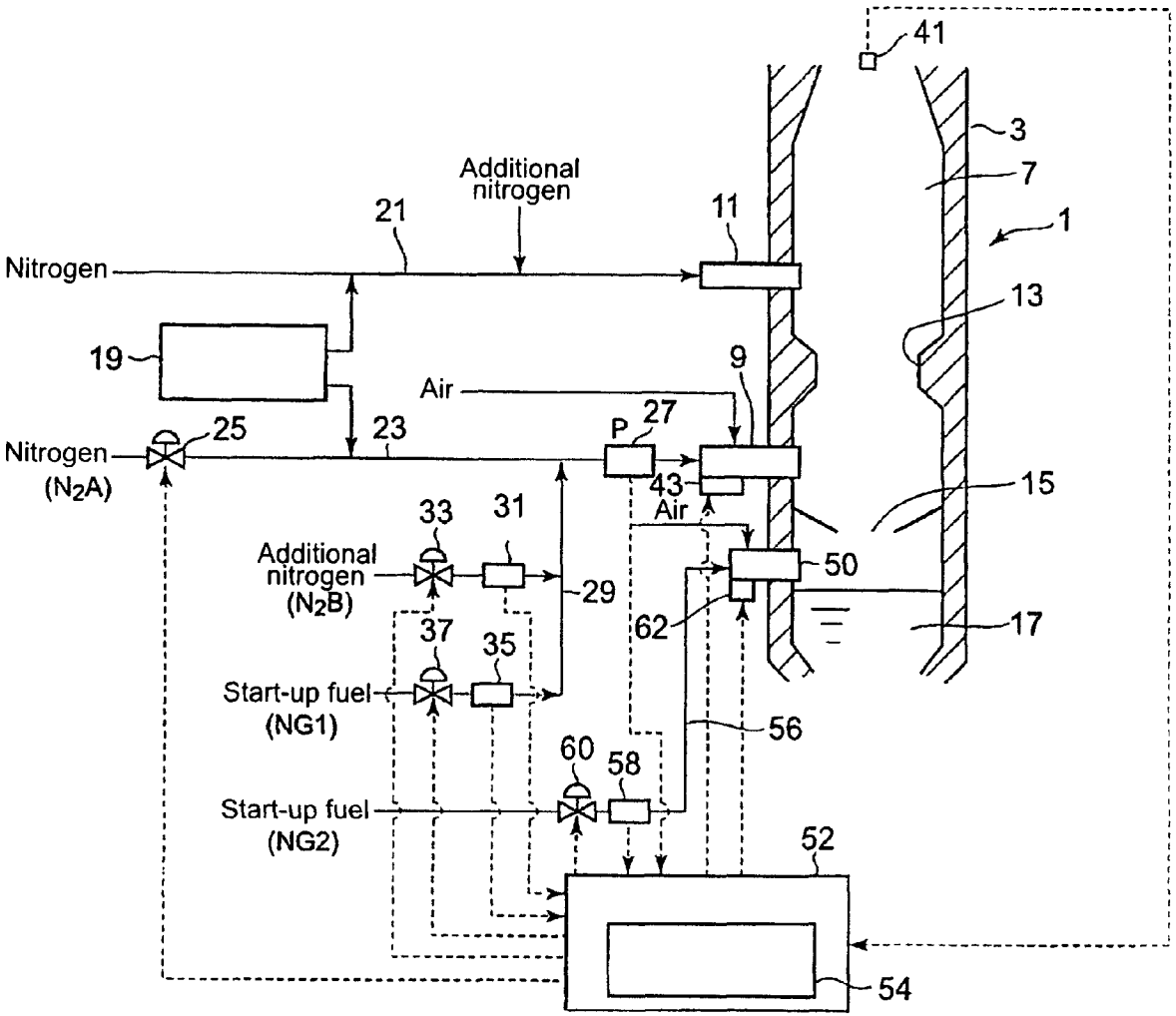
FIG. 3 shows an outline of a coal gasifier according to the second embodiment of the present invention, corresponding to FIG. 1.
Figure 4:
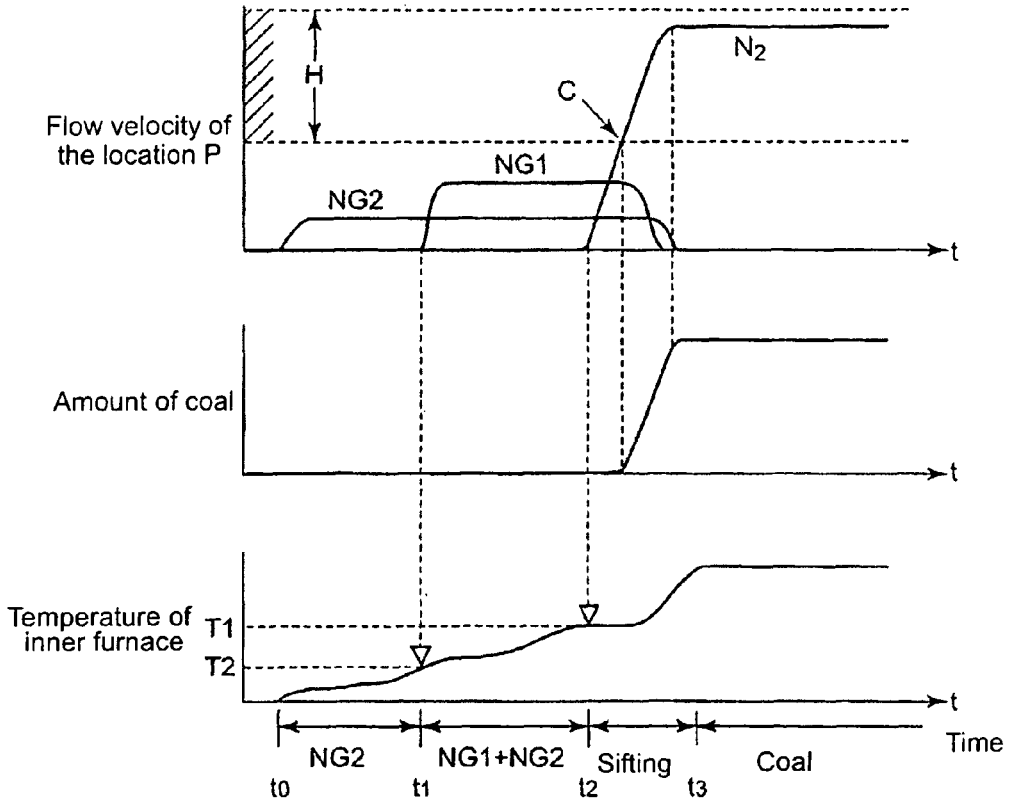
FIG. 4 explains the furnace operation transition during the start-up of the furnace according to the second embodiment, corresponding to FIG. 2.

The second embodiment according to the present invention is now explained in consultation with FIGS. 3 and 4. FIG. 3 shows an outline of a coal gasifier according to the second embodiment of the present invention, whereby FIG. 1 corresponds to the first embodiment, while FIG. 3 corresponds to the second embodiment.

The difference between the first and second embodiments is that an assist warm-up burner (a start assist burner) 50 is provided in the second embodiment in contrast to the first embodiment. Except this difference, the same configuration as that of the first embodiment is followed; thus, the same symbol is used for a same configuration member.

As shown in FIG. 3, the assist warm-up burner (a start assist burner) 50 is provided below the combustor burner 9 as well as the slag tap 15; a start control means 52 for controlling the operation of the furnace comprises a start assist burner controller 54 for controlling the start-up operation of the furnace so that the inside of the furnace is heated up by use of the assist warm-up burner 50 till the temperature of the furnace inside reaches a second temperature T2 which is a temperature lower than the first temperature T1.

The start assist burner controller 54 performs the control as to the supply of the start-up fuel (NG2) so that the start-up fuel (NG2) is supplied to the assist warm-up burner (a start assist burner) 50, through a start assist gas supply passage 56 until the temperature of the furnace inside reach the second temperature T2.

The concrete explanation as to the start-up control is now given in consultation with FIG. 4 as to the furnace operation transition during the start-up of the furnace.

To the start control means 52, the same kind of detected signals as in the first embodiment is inputted. In addition to these signals, a signal from a flow meter 58 as to the start-up fuel (NG2) supplied to the assist warm-up burner (a start assist burner) 50 is inputted to the start control means 52, and the flow rate of the start-up fuel (NG2) is regulated by a flow control valve 60. Further, an igniter 62 is fitted to the assist warm-up burner (a start assist burner) 50, as is the case with the combustor burner 9.

At first, in starting of the operation of the coal gasifier 1, air is supplied to the assist warm-up burner (a start assist burner) 50 to activate the igniter 62 fitted to the tip of the burner 50. Then, the flow-regulating valve 60 is opened to supply the start-up fuel (NG2) so that a natural gas as the fuel (NG2) is ignited.

When the start-up fuel (NG2) is ignited at a time point t0, the temperature in the coal gasifier 1 starts rising as shown in FIG. 4. When the temperature of the inside of the furnace reaches the second temperature T2 at a time point t1, air is supplied to the combustor burner 9 so as to activate the igniter 43 fitted to the tip of the combustor burner 9. Then, the flow-regulating valve 37 is opened so as to supply the start-up fuel (NG1) to ignite the natural gas as the fuel (NG1).

After the start-up fuel (NG1) is ignited at the time point t1, the temperature of the inside of the furnace continues to rise. As the pulverized coal can be ignited when the temperature of the inside of the furnace reaches the first temperature T1 at a time point t2, the operation by the start-up fuels (NG1 and NG2) is shifted to the operation by the pulverized coal.

The fuel shift from the start-up fuel (NG1, NG2) into the pulverized coal after the time point t2 is the same as that in the first embodiment. When the velocity of the flow in the coal fuel supply passage 23 reaches a lower limit C of a predetermined stable transfer flow velocity range H, the supply of the pulverized coal is started. Then, the openings of the flow regulating valves 25 and 33 are controlled to increase the flow rate of the pulverized coal. Further, the flow of the natural gas (NG1, NG2) as the start-up fuel is replaced by a flow of inert nitrogen, and the supply of the natural gas is finally stopped at a time point t3 and the furnace operation only with the pulverized coal is continued.

According to the second embodiment as described above, the start-up of the furnace is performed by the heat-up by means of the assist warm-up burner (a start assist burner) 50 and the combustor burner 9; thus, in comparison with the conventional way where only a warm-up burner performs the warming-up of the furnace, the time span in which the temperature of the pulverized coal supplied to the furnace inside reaches the first temperature T1 at which the pulverized coal ignites can be reduced. Further, in comparison with the warm-up burner that is used in the conventional furnaces, the assist warm-up burner 50 can be of a small size; thus, the height of the coal gasifier can be reduced. Moreover, the upper side and the lower side of the slag tap furnace can be evenly heated up; the slag discharge during the start-up operation, namely during the incipient pulverized coal charging, can be stabilized.

(The Third Embodiment)

The third embodiment according to the present invention is now explained in consultation with FIG. 5.

In the method as well as device thereby, according to this third embodiment, a sealing gas supply passage 67 for supplying an inert sealing gas toward the (coal) fuel supply passage 23 is provided, the supply passage 67 being connected to a point on the passage 23 between the (coal hopper) outlet 63 of a pulverized coal hopper (funnel) 19 for storing and supplying the pulverized coal and a junction point (a cross point) 65 as to the passage 23 and the starting gas supply passage 29.

In the sealing gas supply passage 67, nitrogen gas as a sealing gas is supplied.

By supplying the sealing gas as described above, the starting flammable gas for starting-up the operation of the furnace can be prevented from flowing back in the (coal) fuel supply passage 23 toward the pulverized coal hopper (funnel) 19. Thus, the starting flammable gas can be stably supplied to the coal gasifier during the start-up furnace operation that is described in connection to the above first and second embodiments.

INDUSTRIAL APPLICABILITY

According to the present invention, a starting method of a coal gasifier and a starting device thereby can be provided, whereby pulverized coal is transferred toward the furnace inside by use of an inert transfer gas and the coal thrown into the furnace inside is gasified, wherein a warm-up (start-up) burner can be dispensed with, and a start-up combustion chamber can be accordingly eliminated; a start-up combustion chamber can be down-sized in comparison with the conventional start-up combustion chambers, even when a start-up chamber has to be provided; and, the height of the whole furnace can be restrained.

The invention claimed is:

1. A starting method of a coal gasifier in which pulverized coal is transferred to an inside of a furnace by an inert transfer gas to gasify coal thrown into the furnace, the coal gasifier being provided with a reductor burner at an upper side of the coal gasifier for supplying fuel that is pulverized coal to a reduction furnace which performs coal gasification reaction, a combustor burner located below the reductor burner for supplying the fuel that is pulverized coal to a combustion furnace which generates heat, and a slag tap below the combustor burner without a start-up burner starting up an operation of the furnace below the slag tap, the method comprising:

letting air into the combustor burner to activate an igniter installed in the combustor burner;

after the igniter is activated, supplying a flammable gas for starting-up the furnace to a part way of a fuel supply passage for supplying pulverized coal while pulverized coal supply to the combustor burner is stopped so as to ignite the flammable gas;

starting to supply a transfer gas that transfers the pulverized coal after a temperature of the inside of the furnace reaches a first predetermined temperature at which the pulverized coal can be ignited;

reducing a supply rate of the transfer gas so as to have a flow velocity in the coal fuel supply passage for the combustor burner raised to be within a predetermined stable transfer flow velocity range of the pulverized coal by the transfer gas and the flammable gas;

starting the pulverized coal supply when the flow velocity reaches the stable transfer flow velocity range; and increasing supply rates of the pulverized coal and the transfer gas while reducing a flow rate of the flammable gas to replace the flammable gas by the transfer gas, so that a start-up combustion is shifted to a normal operation combustion performed by the pulverized coal and the transfer gas.

2. The starting method of a coal gasifier according to claim 1, further comprising supplying an inert sealing gas between an outlet of a pulverized coal hopper and a junction point of the fuel supply passage and a starting gas supply passage when supplying the flammable gas for starting-up the furnace to the fuel supply passage so that back-flow of a starting flammable gas towards the pulverized coal hopper is prevented by the inert sealing gas.

3. A starting device of a coal gasifier in which pulverized coal is transferred to an inside of a furnace by an inert transfer gas to gasify coal thrown into the furnace, wherein the coal gasifier comprises a reductor burner at an upper side of the coal gasifier for supplying fuel that is pulverized coal to a reduction furnace which performs coal gasification reaction;

a combustor burner located below the reductor burner for supplying the fuel that is the pulverized coal to a combustion furnace which generates heat;

a slag tap below the combustor burner without a start-up burner starting up an operation of the furnace below the slag tap;

an igniter installed in the combustor burner;

a starting gas supply passage for supplying a flammable gas for starting-up the furnace to a part way of a fuel supply passage while pulverized coal supply to the combustor burner is stopped after the igniter is activated by letting air into the combustor burner;

a temperature sensor for sensing a temperature of the inside of the furnace; and a start control unit, wherein the start control unit starts supplying of a transfer gas for transferring the pulverized coal after detecting that the temperature of the inside of the furnace reaches a first predetermined temperature at which the pulverized coal can be ignited on a basis of a detected value from the temperature sensor, and regulates a supply rate of the transfer gas so as to raise a flow velocity in the coal fuel supply passage for the combustor burner to be within a predetermined stable transfer velocity range of the pulverized coal by the transfer gas and the flammable gas, when the flow velocity reaches the stable transfer flow velocity range, the pulverized coal supply is started, and supply rates of the pulverized coal and the transfer gas are increased while reducing a flow rate of the flammable gas so as to replace the flammable gas by the transfer gas in order to sift the start-up combustion to a normal operation combustion performed by the pulverized coal and the transfer gas, and the combustor burner works as the start-up burner.

4. The starting device of a coal gasifier according to claim 3, wherein an inert sealing gas is supplied between an outlet of a pulverized coal hopper and a junction point of the fuel supply passage and a starting gas supply passage when supplying the flammable gas for starting-up the furnace to the fuel supply passage so that back-flow of a starting flammable gas towards the pulverized coal hopper is prevented by the inert sealing gas.

5. The starting device of a coal gasifier according to claim 3, further comprising a first flow meter metering a flow amount of the air supplied to an inlet side of the combustor burner, a second flow meter metering a flow amount of nitrogen supplied to the combustor burner, and a third flow meter metering a flow amount of the flammable gas supplied to the combustor burner, wherein the control unit detects signals from the first flow meter, the second flow meter, and the third flow meter to control the amount of the air, the nitrogen, and the flammable gas supplied to the combustor burner.

6. The starting device of a coal gasifier according to claim 5, wherein the igniter is an igniter of a red heated wire type or a plasma generating type.

7. The starting device of a coal gasifier according to claim 3, wherein the control unit regulates the supply rate of the transfer gas and a supply rate of nitrogen so as to raise the flow velocity in the coal fuel supply passage for the combustor burner to be within the predetermined stable transfer velocity range.

* * * * *